US008644737B2

(12) United States Patent
Oikawa et al.

(10) Patent No.: US 8,644,737 B2
(45) Date of Patent: Feb. 4, 2014

(54) DEVELOPING DEVICE AND ELECTROPHOTOGRAPHIC IMAGE FORMING APPARATUS INCLUDING THE SAME

(75) Inventors: Mitsuru Oikawa, Suwon-si (KR); Seong-min Park, Ansan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 279 days.

(21) Appl. No.: 13/280,774

(22) Filed: Oct. 25, 2011

(65) Prior Publication Data

US 2012/0308269 A1 Dec. 6, 2012

(30) Foreign Application Priority Data

Jun. 3, 2011 (KR) ..... 10-2011-0054151

(51) Int. Cl.
*G03G 15/08* (2006.01)

(52) U.S. Cl.
USPC ..... 399/254; 399/256; 399/259; 399/260

(58) Field of Classification Search
USPC ..... 399/107, 119, 120, 252–260
See application file for complete search history.

(56) References Cited

U.S. PATENT DOCUMENTS

| | | | | |
|---|---|---|---|---|
| 7,738,819 | B2 * | 6/2010 | Honda et al. | 399/263 |
| 7,835,672 | B2 * | 11/2010 | Sakamoto et al. | 399/254 |
| 2009/0245882 | A1 * | 10/2009 | Ozeki et al. | 399/260 |

* cited by examiner

*Primary Examiner* — Hoan Tran
(74) *Attorney, Agent, or Firm* — Stanzione & Kim, LLP

(57) ABSTRACT

A developing device including a two-component developer including toner and a carrier. The developing device includes first and second developer housing portions divided by a barrier wall having first and second communication openings. A development member is disposed on the first developer housing portion, and first and second agitators are respectively disposed on the first and second developer housing portions. The developing device satisfies $1.8 \leq (Wa/Wb) \leq 3.0$, wherein Wa represents a mass of the developer in the first developer housing portion and Wb represents a mass of the developer in the second developer housing portion at an equilibrium state.

21 Claims, 6 Drawing Sheets

DEVELOPING DEVICE AND ELECTROPHOTOGRAPHIC IMAGE FORMING APPARATUS INCLUDING THE SAME

CROSS-REFERENCE TO RELATED APPLICATIONS

This application claims priority under 35 U.S.C. §119 to Korean Patent Application No. 10-2011-0054151, filed on Jun. 3, 2011, in the Korean Intellectual Property Office, the disclosure of which is incorporated herein by reference in its entirety.

BACKGROUND OF THE INVENTION

1. Field of the Invention

The present general inventive concept relates to a developing device including a two-component developer including toner and a magnetic carrier, and an image forming apparatus including the developing device.

2. Description of the Related Art

In an electrophotographic image forming apparatus, light that is changed to correspond to image information is irradiated to a photoconductor to form an electrostatic latent image on a surface of the photoconductor, toner is supplied to the electrostatic latent image to develop the electrostatic latent image into a visible toner image, and then the visible toner image is transferred and fixed onto a recording medium, thereby printing an image corresponding to the visible toner image on the recording medium.

An image forming method using an electrophotographic image forming apparatus can be classified as a one-component development method using a one-component developer including toner, or as a two-component development method using a two-component developer including toner and a carrier in which only the toner is used for development on a photoconductor.

However, in the two-component development method, if an image forming speed is increased or a relatively high coverage image is consecutively printed, toner consumption per unit hour in a developing device is increased, and corresponding to the increased toner consumption, an amount and a speed of toner supplied to the developing device need to be increased. However, the increase in the toner supply amount results in a large developing device, and the increase in the toner supply speed results in a toner charge defect and non-uniform image concentration.

SUMMARY OF THE INVENTION

The present general inventive concept provides a developing device that is capable of producing good image quality during high-speed printing, and an image forming apparatus including the developing device.

The present general inventive concept also provides a developing device that is capable of producing uniform image quality during high-coverage image printing, and an image forming apparatus including the developing device.

The present general inventive concept also provides a miniaturized developing device and an image forming apparatus including the miniaturized developing device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a developing device to supply toner in a developer including the toner and a carrier to an electrostatic latent image formed on an image carrier and to develop the electrostatic latent image, the developing device including a first developer housing portion including a development member to attach the developer to an outer circumference thereof to supply the toner to the image carrier, and a first agitator to agitate and transfer the developer in a first axis direction, a second developer housing portion in which a toner loading hole to load the toner, and a second agitator to agitate and transfer the developer in a second axis direction that is opposite with respect to the first axis direction; and a barrier wall to divide the developing device into the first developer housing portion and the second developer housing portion, and has a first communication opening located on a lower stream side of the second axis direction and a second communication opening located on a lower stream side of the first axis direction to allow the developer to be transferred in the first axis direction and the second axis direction and circulated between the first developer housing portion and the second developer housing portion, wherein the developing device satisfies $1.8 \leq Wa/Wb \leq 3.0$, wherein Wa represents a mass of the developer in the first developer housing portion and Wb represents a mass of the developer in the second developer housing portion at an equilibrium state.

The developing device may satisfy $$Tcirc \leq \frac{3}{2} \times \frac{Wa}{TMA \times Pa \times PPM},$$

wherein PPM represents a number of reference paper sheets on which an image is printed per minute, Pa represents an area of each reference paper sheet, Tcirc represents a time during which the developer is circulated once, and TMA represents an amount of the toner in a unit area of the image carrier.

The developing device may satisfy $Z1 > Z2$, wherein Z1 represents a pore size of the first communication opening, and Z2 represents a pore size of the second communication opening.

Each of the first agitator and the second agitator may be an auger including a shaft and a blade, wherein a pitch of the blade of the first agitator is smaller than a pitch of the blade of the second agitator.

The developing device may satisfy $0 < Y - \{X + (Z1 + Z2)/2\} < 15$ mm, wherein Z1 represents a pore size of the first communication opening, Z2 represents a pore size of the second communication opening, X represents an inner interval between the first and second communication openings, and Y represents an effective image area of the development member.

The foregoing and/or other features and utilities of the present general inventive concept may also be achieved by providing a developing device to supply toner in a developer including the toner and a carrier to an electrostatic latent image formed on an image carrier and to develop the electrostatic latent image, the developing device including a first developer housing portion including a development member to attach the developer to an outer circumference thereof to supply the toner to the image carrier, and a first agitator to agitate and transfer the developer in a first axis direction, a second developer housing portion including a toner loading hole to load the toner, and a second agitator to agitate and transfer the developer in a second axis direction that is opposite with respect to the first axis direction; and a barrier wall to divide the developing device into the first developer housing portion and the second developer housing portion, and has a first communication opening located on a lower stream side of the second axis direction and a second communication opening located on a lower stream side of the first axis direction to allow the developer to be transferred in the first axis direction and the second axis direction and circulated between the first developer housing portion and the second developer housing portion, wherein the developing device satisfies $0<Y-\{X+(Z1+Z2)/2\}<15$ mm, wherein Z1 represents a pore size of the first communication opening, Z2 represents a pore size of the second communication opening, X represents an inner interval between the first communication opening and the second communication opening, and Y represents an effective image area of the development member.

The foregoing and/or other features and utilities of the present general inventive concept may also be achieved by providing an electrophotographic image forming apparatus including a developer including toner and a carrier, the electrophotographic image forming apparatus including an image carrier on which an electrostatic latent image is formed, and a developing device to supply the toner to the electrostatic latent image to develop the electrostatic latent image, including a first developer housing portion including a development member to attach the developer to an outer circumference thereof to supply the toner to the image carrier, and a first agitator to agitate and transfer the developer in a first axis direction, a second developer housing portion in which a toner loading hole to load the toner, and a second agitator to agitate and transfer the developer in a second axis direction that is opposite with respect to the first axis direction; and a barrier wall to divide the developing device into the first developer housing portion and the second developer housing portion, and has a first communication opening located on a lower stream side of the second axis direction and a second communication opening located on a lower stream side of the first axis direction to allow the developer to be transferred in the first axis direction and the second axis direction and circulated between the first developer housing portion and the second developer housing portion, wherein the developing device satisfies $1.8\leq Wa/Wb\leq 3.0$, wherein Wa represents a mass of the developer in the first developer housing portion and Wb represents a mass of the developer in the second developer housing portion at an equilibrium state.

The foregoing and/or other features and utilities of the present general inventive concept may also be achieved by providing an electrophotographic image forming apparatus including a developer including toner and a carrier, the electrophotographic image forming apparatus including an image carrier on which an electrostatic latent image is formed, and a developing device to supply the toner to the electrostatic latent image to develop the electrostatic latent image, including a first developer housing portion including a development member to attach the developer to an outer circumference thereof to supply the toner to the image carrier, and a first agitator to agitate and transfer the developer in a first axis direction, a second developer housing portion including a toner loading hole to load the toner, and a second agitator to agitate and transfer the developer in a second axis direction that is opposite with respect to the first axis direction; and a barrier wall to divide the developing device into the first developer housing portion and the second developer housing portion, and has a first communication opening located on a lower stream side of the second axis direction and a second communication opening located on a lower stream side of the first axis direction to allow the developer to be transferred in the first axis direction and the second axis direction and circulated between the first developer housing portion and the second developer housing portion, wherein the developing device satisfies $0<Y-\{X+(Z1+Z2)/2\}<15$ mm, wherein Z1 represents a pore size of the first communication opening, Z2 represents a pore size of the second communication opening, X represents an inner interval between the first communication opening and the second communication opening, and Y represents an effective image area of the development member.

The foregoing and/or other features and utilities of the present general inventive concept may also be achieved by providing an electrophotographic image forming apparatus, including a photoconductive device upon which an electrostatic latent image is formed, a first developer housing portion, including a developing roller to supply toner to the photoconductive device to transfer the electrostatic latent image onto a printing medium, and a first agitator to rotate in a first axis direction to agitate and transfer the toner to the developing roller, and a second developer housing portion, including a second agitator to rotate in a second axis direction to agitate and transfer the toner to the first agitator, wherein a mass of the toner within the first developer housing portion is maintained at a level greater than or equal to a mass of the toner within the second developer housing portion.

At least one of the first agitator and the second agitator may be altered with respect to at least one of a pitch, a rotational speed, and a circumference to increase a charge of the toner within the first developer housing portion.

The electrophotographic image forming apparatus may further include a barrier wall to separate the first agitator from the second agitator, including a first communication opening to allow the toner to transfer from the second agitator to the first agitator in a first direction, and a second communication opening to allow the toner to transfer from the first agitator to the second agitator in a second direction.

The image forming apparatus may satisfy $1.8\leq Wa/Wb\leq 3.0$, such that Wa represents a mass of the toner in the first developer housing portion and Wb represents a mass of the developer in the second developer housing portion at an equilibrium state.

The image forming apparatus may satisfy $0<Y-\{X+(Z1+Z2)/2\}<15$ mm, such that Z1 represents a pore size of the first communication opening, Z2 represents a pore size of the second communication opening, X represents an inner interval between the first communication opening and the second communication opening, and Y represents an effective image area of the developing roller.

The changing of a pore size of at least one of the first communication opening and the second communication opening may change an amount of the toner per unit area on the developing roller.

The electrophotographic image forming apparatus may further include a toner concentration sensor to detect a concentration of the toner within the second developer housing portion, and a controller to control the concentration of the toner within the second developer housing portion based on the detected concentration.

The electrophotographic image forming apparatus may further include a toner loading member to supply the toner to the second agitator.

The toner loading member may be detachable.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
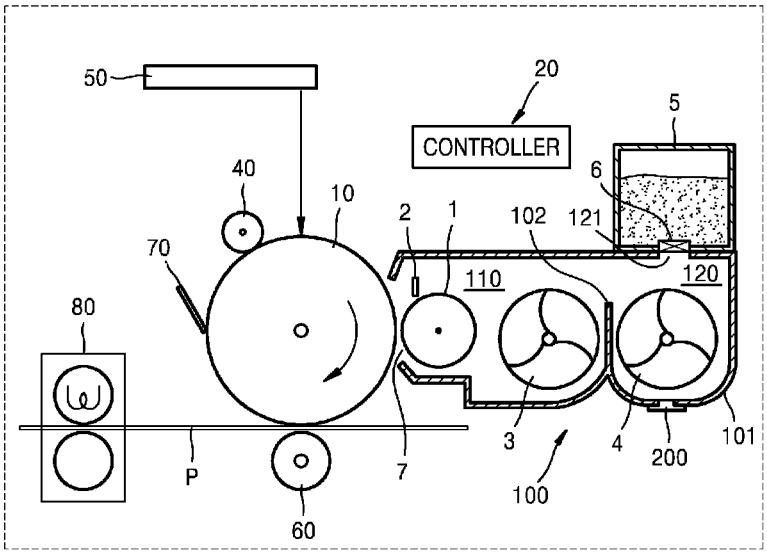
FIG. 1 is a view of an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a view of an image forming apparatus according to an exemplary embodiment of the present general inventive concept. The image forming apparatus may be a mono-color image forming apparatus employing a two-component developer including, as a developer, toner and a carrier that is magnetic. For example, the toner may be black.

A photoconductive drum 10 is an example of an image carrier on which an electrostatic latent image is formed, and may be a cylindrical metallic pipe with an outer circumference (i.e., an outer surface) upon which a photoconductive layer having photoconductivity is formed. Alternatively, instead of the photoconductive drum 10, any other type of photoconductive device, such as a photoconductive belt (not illustrated) including a circulating belt and a photoconductive layer formed on an outer surface of the circulating belt, may be used.

An electrifying roller 40 is an example of a charging device to charge a surface of the photoconductive drum 10 with a uniform charge potential. A charge bias voltage is applied to the electrifying roller 40. Instead of the electrifying roller 40, a corona charging device that uses corona discharging may be used.

A light exposing device 50 irradiates light corresponding to image information to the surface of the electrified photoconductive drum 10 to form an electrostatic latent image. The light exposing device 50 may be a laser scanning unit (LSU) that deflects light irradiated from a laser diode by using a polygon mirror in a main scan direction and irradiates the deflected light to the photoconductive drum 10 may be used.

A developing device 100 may house a developer. The developing device 100 supplies the toner among the developer to the electrostatic latent image formed on the photoconductive drum 10 to form a visible toner image on the surface of the photoconductive drum 10. The developer housed in the developing device 100 is transferred by agitation by first and second agitators 3 and 4. During the agitation, the toner is electrified due to friction with the carrier.

A development roller 1 is an example of a development member to supply the toner to the surface of the photoconductive drum 10. The development roller 1 is disposed facing the photoconductive drum 10. The development roller 1 may be spaced from the photoconductive drum 10 by a development gap 7. The development gap 7 may have a width of a few microns to several hundreds microns.

Figure 2:
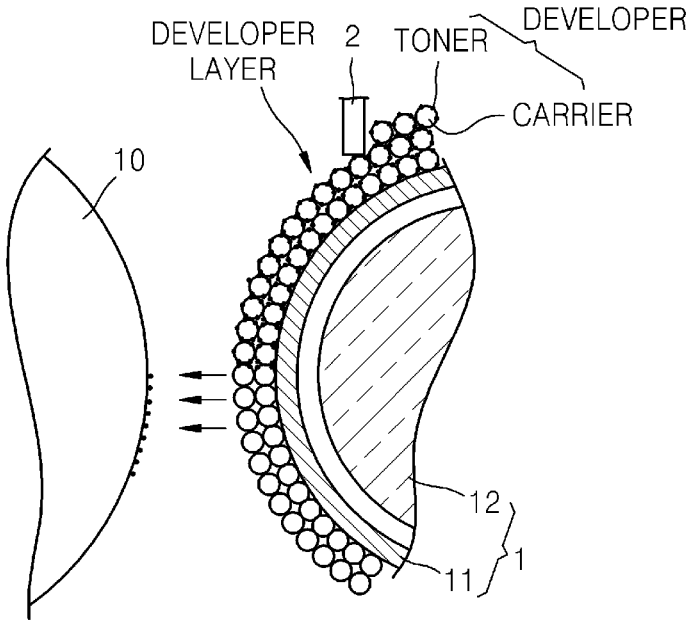
FIG. 2 is a view illustrating a development process performed by the image forming apparatus of FIG. 1.

Referring to FIG. 2, according to an exemplary embodiment of the present general inventive concept, the development roller 1 may include a sleeve 11 that rotates and a magnet 12 disposed inside the sleeve 11. The sleeve 11 and the photoconductive drum 10 may rotate in opposite directions. That is, in a region in which the sleeve 11 faces the photoconductive drum 10, surfaces of the sleeve 11 and the photoconductive drum 10 move in the same directions. Accordingly, a rotational linear velocity of the sleeve 11 may be about 1.6 times greater than a rotational linear velocity of the photoconductive drum 10. However, the present general inventive concept is not limited thereto, and the rotational directions of the sleeve 11 and the photoconductive drum 10 may be identical.

The carrier is attached to an outer circumference of the development roller 1 due to a magnetic force of the magnet 12, and the toner is attached to the carrier due to an electrostatic force. In this case, as illustrated in FIG. 2, a developer layer including the carrier and the toner is formed on the outer circumference of the development roller 1. A regulating member 2 regulates a thickness of the developer layer to be uniform. An interval between the regulating member 2 and the development roller 1 may be, for example, from about 0.3 mm to about 1.5 mm.

Due to a development bias voltage applied to the development roller 1, the toner moves from the developer layer formed on the surface of the development roller 1 onto the electrostatic latent image formed on the surface of the photoconductive drum 10 through the development gap 7.

A transfer roller 60 is an example of a transfer device to transfer the toner image formed on the photoconductive drum 10 onto a recording medium P, such as a sheet of paper. The transfer roller 60 is disposed facing the photoconductive drum 10 and forms a transfer nip, and a transfer bias voltage is applied to the transfer roller 60. Due to a transfer electric field formed between the photoconductive drum 10 and the transfer roller 60 by the appliance of the transfer bias voltage, the toner image developed on the surface of the photoconductive drum 10 is transferred onto the recording medium P. Instead of the transfer roller 60, a corona transfer device that uses corona discharging may be used.

The toner image transferred onto the recording medium P is attached to the recording medium P using an electrostatic force. A fixing device 80 applies heat and pressure to the toner image, thereby fixing the toner image onto the recording medium P.

An image forming process will now be described using the structure described above. When the charge bias voltage is applied to the electrifying roller 40, the photoconductive drum 10 is electrified with a uniform charge. The light exposing device 50 irradiates light corresponding to image information to the surface of the photoconductive drum 10 to form an electrostatic latent image. When the development bias voltage is applied to the development roller 1 to form a development electric field between the development roller 1 and the photoconductive drum 10, the toner moves from the developer layer formed on the surface of the development roller 1 to the surface of the photoconductive drum 10, thereby developing the electrostatic latent image. Accordingly, a toner image is formed on the surface of the photoconductive drum 10. The recording medium P is supplied from a paper sheet supplier (not illustrated) to the transfer nip where the photoconductive drum 10 faces the transfer roller 60. Due to the transfer electric field formed by appliance of the transfer bias voltage, the toner image moves from the surface of the photoconductive drum 10 to the recording medium P and is attached to the recording medium P. When the recording medium P passes by the fixing device 80, the toner image is fixed onto the recording medium P due to heat and pressure, thereby completing image printing. A cleaning blade 70 contacts the surface of the photoconductive drum 10, and after the transferring, removes toner remaining on the surface of the photoconductive drum 10.

Figure 3:
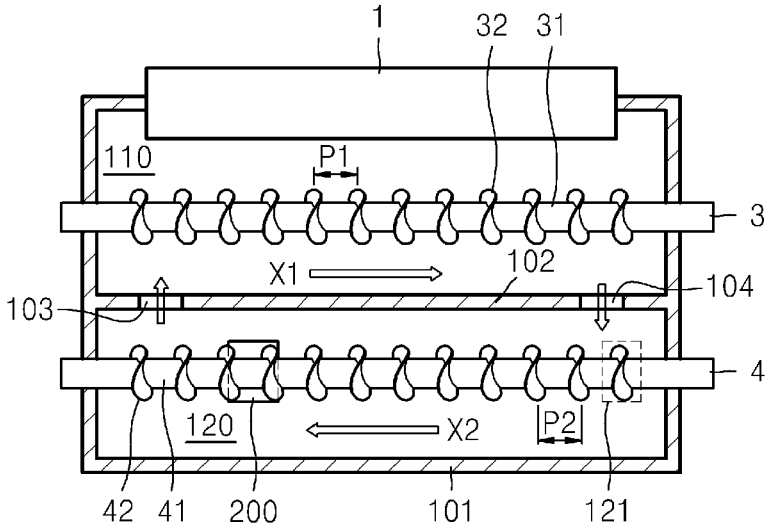
FIG. 3 is a schematic plan view of a developing device illustrated in FIG. 1.

Referring to FIGS. 1 and 3, the developing device 100 includes a first developer housing portion 110 and a second developer housing portion 120 that are divided by a barrier wall 102. For example, the barrier wall 102 may extend in a lengthwise direction of the development roller 1 in a central portion of the developing device 100 to separate the first developer housing portion 110 from the second developer housing portion 120. To connect the first developer housing portion to the second developer housing portion 120, the barrier wall 102 may include a first communication opening 103 and a second communication opening 104. The first communication opening 103 is disposed at a lower stream side in a second axis direction X2 and functions as a path that allows the developer to flow from the second developer housing portion 120 to the first developer housing portion 110. The second communication opening 104 is disposed at a lower stream side in a first axis direction X1 and functions as a path that allows the developer to flow from the first developer housing portion 110 to the second developer housing portion 120.

The first agitator 3 and the development roller 1 are disposed in the first developer housing portion 110. The first agitator 3 may be, for example, an auger including a shaft 31 and a helical blade 32. When the first agitator 3 rotates, the developer present in the first developer housing portion 110 is agitated and transferred in the first axis direction X1, for example, toward a right side of FIG. 3.

The second agitator 4 is disposed in the second developer housing portion 120. The second agitator 4 may be, for example, an auger including a shaft 41 and a helical blade 42. When the second agitator 4 rotates, the developer present in the second developer housing portion 120 is agitated and transferred in the second axis direction X2, for example, toward a left side of FIG. 3.

The developer after being agitated and transferred by the second agitator 4 in the second axis direction X2 is transferred to the first developer housing portion 110 via the first communication opening 103. The first agitator 3 transfers the developer in the first axis direction X1, and agitates and transfers the developer to the second developer housing portion 120 via the second communication opening 104. Due to the structure described above, the developer is transferred to the second developer housing portion 120, to the first communication opening 103, to the first developer housing portion 110, to the second communication opening 104, and then back to the second developer housing portion 120, that is, circulated between the first developer housing portion 110 and the second developer housing portion 120.

A toner loading hole 121 to load the toner is located in the second developer housing portion 120. Through the toner loading hole 121, for example, the toner is loaded into the second developer housing portion 120 from a toner housing portion 5 of the developing device 100. A toner loading member 6 is controlled by a controller 20 and selectively allows the toner to be loaded from the toner housing portion 5 to the second developer housing portion 120. In the embodiment illustrated in FIG. 1, the toner housing portion 5 is included in the developing device 100. However, the present general inventive concept is not limited to the embodiment. For example, the toner housing portion 5 may be located independently from the developing device 100, or may be replaceable. Also, the toner housing portion 5 may be located separated from the developing device 100, and may be connected to the toner loading hole 121 via a loading path (not illustrated). The toner loading hole 121 is located in an upper stream side of the second axis direction X2 of the second developer housing portion 120. By doing so, without an increase in the size of the developing device 100, after newly loading the developer with the toner, the toner therein is sufficiently agitated when it is transferred toward the first communication opening 103 by the second agitator 4 so as to sufficiently charge the toner.

A toner concentration sensor 200 is installed in the second developer housing portion 120 and detects a concentration of the toner in the developer. The toner concentration sensor 200 allows the toner within the second developer housing portion 120 to be maintained at a predetermined reference toner concentration. The toner concentration may be represented by a ratio of a mass of the toner with respect to a total mass of the developer. For example, the toner concentration sensor 200 detects that the toner concentration is lower than the reference toner concentration, the controller 20 drives the toner loading member 6 and allows the toner to be loaded from the toner housing portion 5 to the second developer housing portion 120 via the toner loading hole 121. The reference toner concentration may be, for example, about 7%. The toner concentration sensor 200 may be, for example, a magnetic sensor that indirectly detects the toner concentration by measuring the magnetic carrier. If in a detection area of the toner concentration sensor 200, the carrier is more present than the toner, a magnetic field intensity detected by the magnetic sensor is relatively high, and on the other hand, if the toner is more present than the carrier, a magnetic field intensity detected by the magnetic sensor is relatively low. The magnetic sensor may detect the toner concentration by using a relationship between the detected magnetic field intensity and the toner concentration. As another example, the toner concentration sensor 200 may also be an electrostatic capacity sensor that detects the toner concentration by using a dielectric permittivity difference between the carrier and the toner.

If a printing speed of the image forming apparatus is increased, toner consumption per unit time is increased. Also, when a high-coverage image is printed, an amount of toner transferred to the photoconductive drum 10 through the development roller 1 is relatively high. Thus, the toner concentration is decreased toward the lower stream side of the first axis direction X1 and thus, an image concentration difference between opposite ends in a width direction of a printed image is relatively high.

To solve the problem described above, the developer needs to be circulated at a relatively high speed between the first and second developer housing portions 110 and 120, and also, a toner loading amount needs to be increased. Also, to sufficiently electrify the quickly circulating toner supplied to the development roller 1, an amount of the developer housed in the developing device 100 needs to be increased. To house a great amount of the developer, the size of the developing device 100 needs to be increased. Unless the toner is sufficiently electrified, when the toner is transferred to the photoconductive drum 10 from the development roller 1, the toner may be dispersed and leaked out of the developing device 100, thereby contaminating an inside of the image forming apparatus. To obtain a sufficient toner charging performance, a plurality of agitators may be installed in the second developer housing portion 120. However, this results in an increase in the size of the image forming apparatus and relatively high manufacturing costs.

Accordingly, there is a need to develop a small and inexpensive developing device that produces a printed image having a relatively small concentration deviation during high-speed printing and high-coverage printing while an amount of a developer housed is relatively low and a toner charging capability of the developing device is sufficient.

An amount of the toner that is consumed when the developer is transferred from the upper stream side to the lower stream side of the first axis direction X1 in the first developer housing portion 110, that is, Tsa, is represented as follows:

$$Tsa = Wa \times \Delta Tc/100 \quad \text{(Equation 1)}$$

where ΔTc (%) represents a rate of decrease in the toner concentration when the toner is transferred from the upper stream side to the lower stream side of the first axis direction X1.

The decrease in the toner concentration refers to a difference between the toner concentration on the upper stream side of the first axis direction X1 and the toner concentration on the lower stream side of the first axis direction X1 in the first developer housing portion 110 when an image is formed. The toner concentration difference occurs since the toner is transferred to the photoconductive drum 10 from the development roller 1 when an image is formed.

An amount of the toner consumed to print an image on a paper sheet, that is, Tsb (g/page), is represented as follows:

$$Tsb = TMA \times Pa \times Co/100 \quad \text{(Equation 2)}$$

where TMA (g/cm$^2$) represents a toner amount in a unit area on the photoconductive drum 10, Pa (cm$^2$) represents an effective image size, and Co (%) represents a coverage.

In this regard, the effective image size means, for example, an effective printing area of a reference paper sheet, for example, an A4 paper sheet excluding upper, lower, left, and right margin regions thereof.

If the printing speed, that is, a number of reference paper sheets on which an image can be printed per minute, is referred to as PPM (i.e., pages per minute), a time required to print on one reference paper sheet is a 60/PPM second.

A number of reference paper sheets on which an image can be printed when the developer is transferred from the upper stream side to the lower stream side of the first developer housing portion 110, that is, Ns, may be calculated using above Equations 1 and 2, and is represented as follows:

$$Ns = Tsa/Tsb \quad \text{(Equation 3).}$$

A time during which the developer is transferred from the upper stream side to the lower stream side of the first developer housing portion 110, that is, T1, may be represented as follows:

$$T1 = Ns \times 60/PPM \quad \text{(Equation 4).}$$

A time during which the developer is circulated between the first developer housing portion 110 and the second developer housing portion 120 once, that is, Tcirc, is twice T1, and is represented as follows:

$$\begin{aligned} Tcirc &= 2 \times T1 \quad \text{(Equation 5)} \\ &= 2 \times Ns \times 60/PPM \\ &= 2 \times (Tsa/Tsb) \times (60/PPM) \\ &= 2 \times \left\{ \frac{(Wa \times \Delta Tc/100)}{(TMA \times Pa \times Co/100)} \right\} \times 60/PPM \\ &= 2 \times \left\{ \frac{(Wa \times \Delta Tc)}{(TMA \times Pa \times Co)} \right\} \times 60/PPM. \end{aligned}$$

When a high-coverage image is printed, an image concentration of a transfer medium, for example, an intermediate transfer medium (not illustrated), or a recording medium P may be lowered, or an image concentration difference between opposite ends in a width direction of an image of a transfer medium, for example, an intermediate transfer medium (not illustrated), or a recording medium P may be increased as described above. This is because only the toner of the developer housed in the first developer housing portion 110 is consumed and thus an amount of the toner in the developer attached to the development roller 1 differs at opposite ends in an axis direction. That is, with reference to the first axis direction X1, the toner concentration in the developer on the lower stream side of the first developer housing portion 110 is relatively low, and thus a sufficient amount of the toner is not supplied to the development roller 1.

When evaluated using SPECTROEYE, which is a densitometer manufactured by X-RITE CO., LTD, when an image concentration of an image on a transfer medium, for example, an intermediate transfer medium (not illustrated), or a recording medium P is to be equal to or lower than 0.2, an allowable printing quality can be obtained. To satisfy such a condition, the developer needs to be circulated in such a way that the decrease in the toner concentration in the developer on the upper and lower stream sides of the first developer housing portion 110, that is, the toner concentration decrease rate ΔTc (%) in the first developer housing portion 110, is less than 1%.

Even when the coverage Co (%) is 100%, it is ideal to set a condition to be appropriate to obtain relatively high image quality. However, when an A4 paper sheet is used as a reference paper sheet, and when upper, lower, left, and right margin regions are excluded, only about 92% of an entire sheet area is an effective area to perform printing. Also, during continuous printing, even when the toner concentration is lowered, the image concentration is increased since toner charge amount is relatively low. Accordingly, the coverage Co (%) may be set to be equal to or higher than 80%.

If the conditions of ΔTc≤1% and Co=80% are substituted into Equation 5, $$Tcirc \leq \frac{3}{2} \times \frac{Wa}{TMA \times Pa \times PPM} \quad \text{(Equation 6)}$$

is obtained.

Herein, if an A4 paper sheet is used as a reference paper sheet, Pa may be about 623.7 cm$^2$, and if a Letter size paper sheet is used as a reference paper sheet, Pa may be about 603.2246 cm$^2$.

TMA represents the amount of toner per unit area on the photoconductive drum 10, in other words, a mass of the toner per unit area when a toner layer is formed on a transfer medium, for example, a recording medium P. A transfer rate from the photoconductive drum 10 to the recording medium P may differ according to the toner, a transfer method, etc. For example, when a corotron method is used, the transfer rate is about 85%, when a transfer roller method is used, the transfer rate may be about 90%, and when an intermediate transfer medium is used, transferring is performed twice and thus the transfer rate is about 80%. In addition, a polymerized toner has a higher transfer rate than a pulverized toner and also a toner having higher circularity has a higher transfer rate. Accordingly, an appropriate transfer rate may be selected in consideration of such factors.

Figure 4:
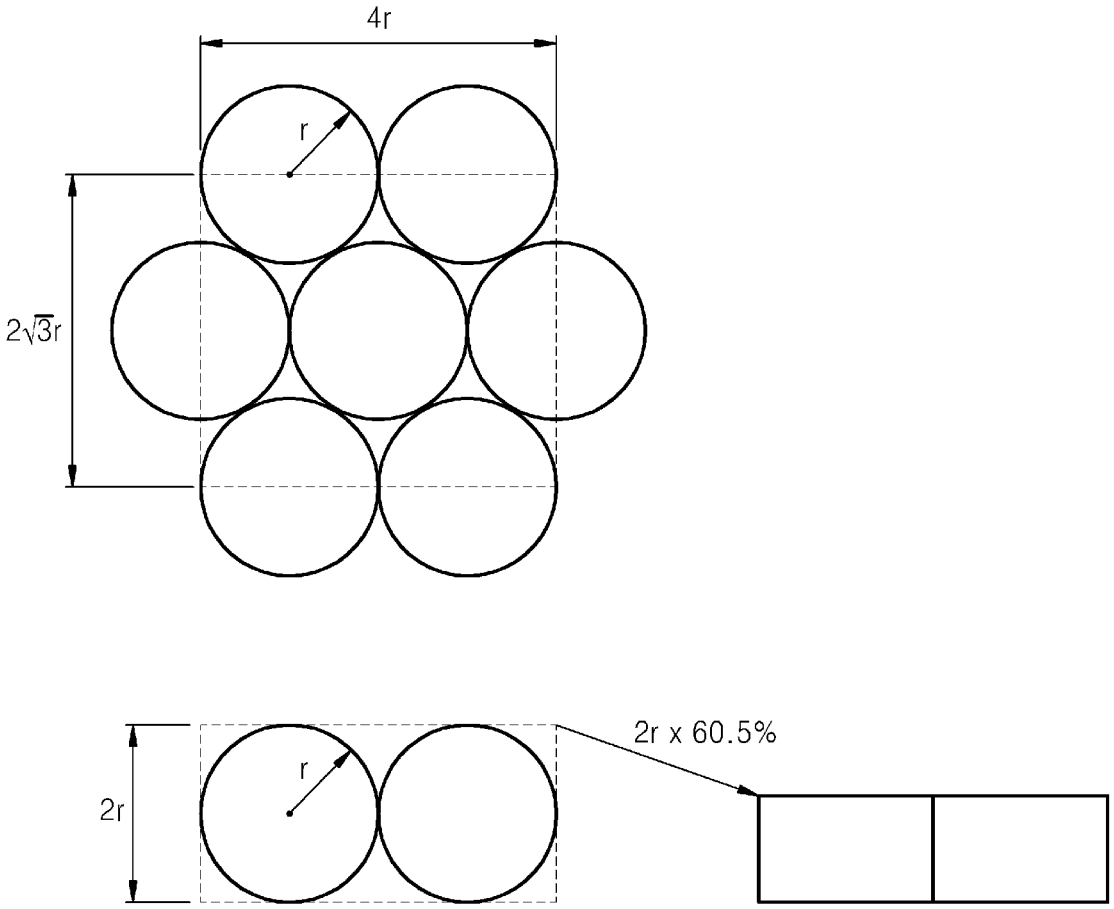
FIG. 4 is a view illustrating a toner amount per unit area on a photoconductive drum.

FIG. 4 is a schematic view of toner particles when toner particles each having a radius r are transferred on a recording medium P without any interval therebetween. Referring to FIG. 4, four toner particles are located in an area of $4r\times2\sqrt{3}r$. In this regard, an area ratio is $$\frac{4\pi r^2}{4r\times2\sqrt{3}\,r}\times100\approx90.7\%,$$

and a volumetric ratio is $$\frac{4\times\frac{4}{3}\pi r^3}{4r\times2\sqrt{3}\,r\times2r}\times100\approx60.5\%.$$

If a true density is represented by Dt g/cm$^2$, a mass of one toner particle is $$Dt\times\frac{4}{3}\pi r^3.$$

Accordingly, TMA is $$\frac{Dt\times4\times\frac{4}{3}\pi r^3}{4r\times2\sqrt{3}\,r}\ \text{g/cm}^2.$$

Figure 5:
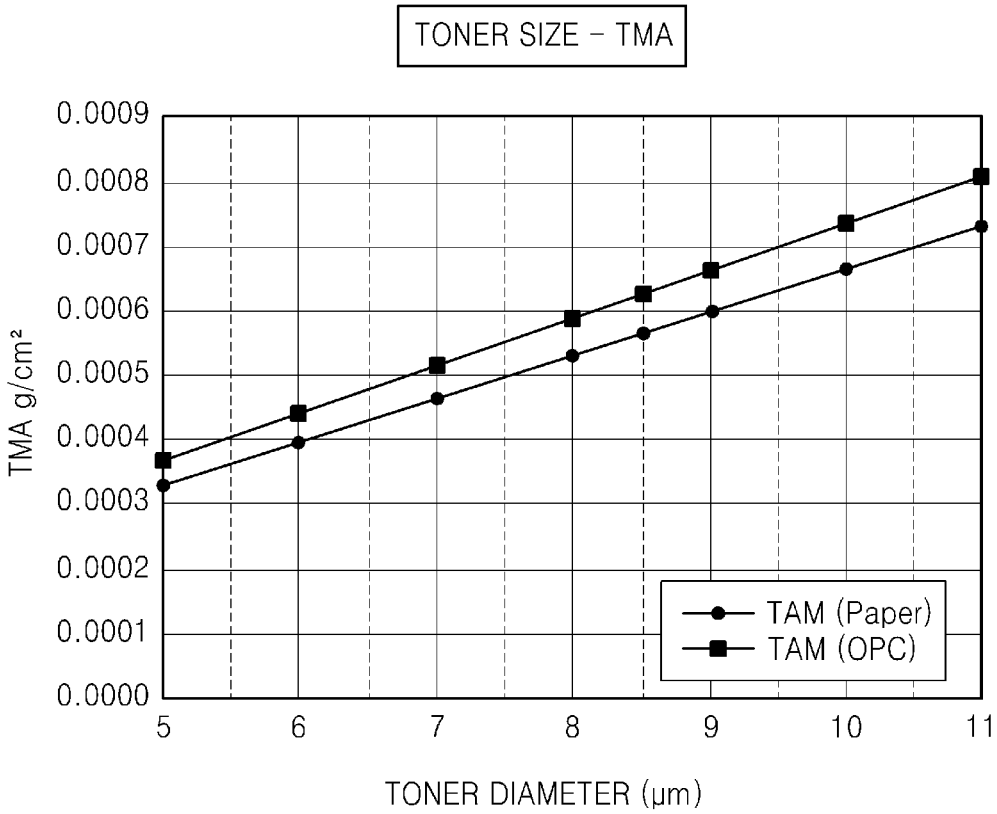
FIG. 5 is a view illustrating a relationship between a toner particle size and a toner amount per unit area on a photoconductive drum.

For example, when an average particle size of 6.7 μm and a true density Dt of 1.1 g/cm$^2$ are used, TMA (paper) of a recording medium P is about 0.00045 g/cm$^2$, and when the transfer rate from photoconductive drum 10 to the recording medium P is about 90%, TMA on the photoconductive drum 10 is about 0.0005 g/cm$^2$. FIG. 5 is a graph illustrating a relationship between a toner particle size and TMA when the true density Dt is 1.1 g/cm$^2$ and the transfer rate is 90%.

For example, when TMA is 0.0005 g/cm$^2$ and Pa is 623.7 cm$^2$ in Equation 6 and an A4 paper sheet is used as a reference paper sheet, one circulation time may be represented by $$Tcirc\leq4.8\times\frac{Wa}{PPM}. \qquad \text{(Equation 7)}$$

For reference, an example of a method of calculating one circulation time will now be described in detail. In a state in which the developing device 100 is stopped, for example, the toner concentration in the developing device 100 is increased by about 1% by supplying the toner to the second developer housing portion 120 via the toner loading hole 121. While the developing device 100 is driven at a predetermined operation speed, the toner concentration sensor 200 detects the toner concentration. When the newly loaded toner arrives at the detection region of the toner concentration sensor 200, the toner concentration sensor 200 detects a relatively high toner concentration. The developing device 100 continues to be driven, and the toner is circulated from the first developer housing portion 110 to the second developer housing portion 120. In this process, the toner is dispersed in the developer to a certain level and thus the toner concentration is slowly decreased. However, whenever a portion initially including the newly loaded toner arrives at the detection region of the toner concentration sensor 200, a relatively high toner concentration is detected by the toner concentration sensor 200. An interval between times when relatively high toner concentrations are detected is one circulation time Tcirc. The circulation time is obtained by measuring an interval between two peaks of an electrical detection signal of the toner concentration sensor 200.

Referring to FIG. 3, when the first agitator 3 and the second agitator 4 are driven, the developer is circulated between the first developer housing portion 110 and the second developer housing portion 120. At an equilibrium state, in each of the first developer housing portion 110 and the second developer housing 120, the mass of the developer is maintained constant. A mass of the developer housed in the first developer housing portion 110 at the equilibrium state will now be referred to as Wa, and a mass of the developer housed in the second developer housing portion 120 will now be referred to as Wb.

A mass of the developer carried by an agitator per unit time, that is, M, may be calculated as follows:

$$M=\eta\rho SPR$$

where S is an effective delivery cross-sectional area of an agitator, P represents a pitch P1 and a pitch P2 of the blade 32 and the blade 42, respectively, R represents a rotational speed R1 and a rotational speed R2 of the agitator 3 and the agitator 4, respectively, ρ is a density of the developer, and η is a delivery efficiency of the agitator.

Wa and Wb may be changed by adjusting design specifications of the first agitator 3 and the second agitator 4, respectively. The design specifications of the first agitator 3 and the second agitator 4 may be controlled by changing, for example, the pitch P1, the pitch P2, the rotational speed R1, the rotational speed R2, and an effective delivery cross-sectional area. The effective delivery cross-sectional area is controllable by changing outer circumferences of the blade 32 and the blade 42 or diameters of the shaft 31 and the shaft 41. Also, even when the first agitator 3 and the second agitator 4 have identical design specifications, when a level of the developer in the first developer housing portion 110 and the second developer housing portion 120 changes, the delivery efficiency of an agitator is changed and thus the mass of the delivered developer is changed. For example a small amount of the developer is loaded into the second developer housing portion 120 and the first agitator 3 and the second agitator 4 are driven. The developer is circulated between the first developer housing portion 110 and the second developer housing portion 120 and reaches the equilibrium state. At the equilibrium state, Ma is equal to Mb and thus Wa and Wb are maintained constant, wherein Ma is a mass of the toner delivered by the first agitator 3 per unit time, and Mb is a mass of the toner delivered by the second agitator 4 per unit time.

To obtain stable image quality during high-speed printing, the toner after having been sufficiently electrified in the second developer housing portion 120 needs to be supplied to the first developer housing portion 110, and in the first developer housing portion 110, a sufficient amount of the toner needs to be supplied to the development roller 1. Wa and Wb at the equilibrium state of the first developer housing portion 110 and the second developer housing portion 120 are experimentally measured while the design specifications of the first agitator 3 and the second agitator 4 are changed.

The developer is loaded into the developing device 100 to a predetermined mass, and the first agitator 3 and the second agitator 4 are rotated until Wa and Wb reach the equilibrium state for a predetermined period of time. Then, the developing device 100 is stopped, and for example, a magnet is used to adsorb and recover the developer in the second developer housing portion 120. A mass of the recovered developer is measured, that is, Wb is measured. Wa is obtained by subtracting Wb from the mass of the loaded developer. Then, development characteristics are evaluated. As development characteristics, a developer balance and a toner agitation property are evaluated.

The developer balance signifies whether a sufficient amount of the developer is supplied to the development roller 1, and the toner agitation property means whether the toner is sufficiently electrified. The developer balance is evaluated by measuring the mass of the developer attached to the development roller 1 after the equilibrium state. If the toner is insufficiently electrified, the toner is dispersed between the development roller 1 and the photoconductive drum 10 and leaks out of the developing device 100. If the amount of the toner leaked is relatively high, the toner is insufficiently electrified and thus the agitation property thereof is relatively bad. The amount of the toner leaked may be measured by attaching the toner leaked out of the developing device 100 to, for example, an adhesive tape, and measuring an optical concentration thereof, and based on a result thereof, the toner agitation property may be confirmed.

TABLE 1

| | First agitator | | | Second agitator | | |
|---|---|---|---|---|---|---|
| | Pitch | Shaft Diameter | Blade | Pitch | Shaft Diameter | Blade |
| Experiment 1 | 14 | 11 | 2(twin) | 16 | 8 | 1(single) |
| Experiment 2 | 14 | 11 | 2(twin) | 16 | 8 | 1(single) |
| Experiment 3 | 14 | 11 | 2(twin) | 18 | 8 | 1(single) |
| Experiment 4 | 14 | 11 | 2(twin) | 18 | 8 | 1(single) |
| Experiment 5 | 16 | 11 | 2(twin) | 16 | 8 | 1(single) |
| Experiment 6 | 16 | 11 | 2(twin) | 16 | 8 | 1(single) |
| Experiment 7 | 16 | 11 | 2(twin) | 18 | 8 | 1(single) |
| Experiment 8 | 16 | 11 | 2(twin) | 18 | 8 | 1(single) |
| Experiment 9 | 12 | 11 | 2(twin) | 16 | 7 | 1(single) |

| | Developer mass | | | Wa/ | Developer | Toner agitation |
|---|---|---|---|---|---|---|
| | Wa + Wb | Wa | Wb | Wb | balance | property |
| Experiment 1 | 200 | 135 | 65 | 2.08 | ○ | ○ |
| Experiment 2 | 170 | 115 | 55 | 2.09 | ○ | ○ |
| Experiment 3 | 200 | 143 | 57 | 2.51 | ○ | ○ |
| Experiment 4 | 170 | 119 | 51 | 2.33 | ○ | ○ |
| Experiment 5 | 200 | 126 | 74 | 1.70 | Δ | ○ |
| Experiment 6 | 170 | 105 | 65 | 1.62 | Δ | ○ |
| Experiment 7 | 200 | 132 | 68 | 1.94 | ○ | ○ |
| Experiment 8 | 170 | 110 | 60 | 1.83 | Δ | ○ |
| Experiment 9 | 170 | 128 | 42 | 3.05 | ○ | Δ |

According to experimental results illustrated in Table 1 above, $$\text{If } 1.8 \leq Wa/Wb \leq 3.0 \qquad \text{(Equation 8)}$$

is satisfied, a sufficient toner electrifying property may be obtained even during high-speed printing, and a sufficient amount of the developer may be supplied to the development roller 1.

If the developing device 100 satisfies Equation 8, the developing device 100 can be manufactured in a small size, and the agitation property and the developer balance thereof are excellent. Thus, even at a relatively high speed, an image with stable quality may be printed. That is, by setting the specifications of the first agitator 3 and the second agitator 4 to satisfy Equation 8, stable image quality may be obtained during high-speed printing with only two agitators.

Also, if the developing device 100 satisfies Equation 6 or Equation 7, even when a high coverage image is printed, an image concentration difference at opposition ends in a width direction of printed image hardly occurs.

Referring to Equations 6 and 7, a longer time during which the developer is circulated once between the first developer housing portion 110 and the second developer housing portion 120, that is, Tcirc, increases printing quality. Accordingly, a better printing quality may be achieved when Wa is increased.

To increase Wa, the first communication opening 103 may be larger than the second communication opening 104. Also, the pitch P1 of the blade 32 of the first agitator 3 may be narrower than the pitch P2 of the blades 42 of the second agitator 4.

To decrease a size of the developing device 100, as described above, it is important to minimize the amount of the developer housed in the first developer housing portion 110 and the second developer housing portion 120, in order to obtain good image quality during high-speed printing and high-coverage image printing. Alternatively, a width of the developing device 100 (see W in FIG. 6) may be minimized so as to minimize the size of the developing device 100.

Figure 6:
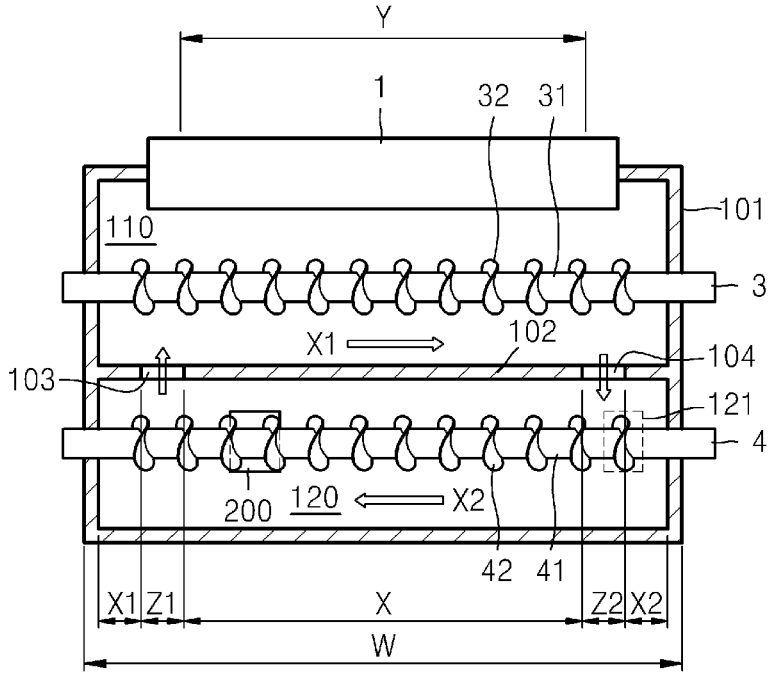
FIG. 6 is a schematic plan view of a developing device illustrated in FIG. 1.

Referring to FIG. 6, if the first communication opening 103 and the second communication opening 104 are located outside a width Y of an image area, the width W of the developing device 100 is increased as much as a pore size Z1 and a pore size Z2 of the first communication opening 103 and the second communication opening 104, respectively. In this case, the width Y of the image area means a widthwise direction of the developer layer on the development roller 1, and in particular, a length that is regulated by the regulating member 2.

Regarding a typical developing device, X+(Z1+Z2)/2 is greater than the width Y of the image area to stabilize the developer balance.

DMA (i.e., developer mass per area) balance, that is, an amount of the developer per unit area on the development roller 1, and toner dispersion were evaluated while an inner interval X between the first communication opening 103 and the second communication opening 104 and the pore size Z1 and pore size Z2 of the first communication opening 103 and second communication opening 104, respectively are changed. As a result, it was confirmed that if $$0 < Y - \{X + (Z1 + Z2)/2\} < 15 \text{ mm} \qquad \text{(Equation 9)}$$

is satisfied, a developing device having good DMA balance and small toner dispersion may be embodied in a small size in a width direction thereof.

Table 2 below shows experiment results obtained to confirm usefulness of Equation 9. In Table 2 below, X1 and X2 respectively denote intervals between outer sides of the first communication opening 103, the second communication opening 104 and an inner wall of the housing 101.

TABLE 2

| | X1 | Z1 | X | Z2 | X2 |
|---|---|---|---|---|---|
| Embodiment 1 | 10 | 30 | 167 | 40 | 10 |
| Embodiment 2 | 10 | 30 | 187 | 10 | 20 |
| Embodiment 3 | 10 | 20 | 197 | 10 | 20 |
| Embodiment 4 | 10 | 15 | 202 | 10 | 20 |
| Embodiment 5 | 10 | 20 | 197 | 15 | 15 |
| Embodiment 6 | 10 | 20 | 187 | 25 | 15 |

| | X + (Z1 + Z2)/2 | Y-{X + ((Z1 + Z2)/2} | DMA balance | Toner Dispersion | Overall Evaluation |
|---|---|---|---|---|---|
| Embodiment 1 | 202 | 22 | Δ | x | x |
| Embodiment 2 | 207 | 17 | x | x | x |
| Embodiment 3 | 212 | 12 | x | ○ | Δ |
| Embodiment 4 | 214.5 | 9.5 | x | ○ | Δ |
| Embodiment 5 | 214.5 | 9.5 | ○ | ○ | ○ |
| Embodiment 6 | 209.5 | 14.5 | x | ○ | Δ |

For example, DMA balance may be evaluated by using an average value of three DMA values of the developer in a 5 mm×20 mm area spaced inward from left and right ends of the surface of the development roller 1 by 10 mm to 30 mm, and an average value of three DMA values of the developer in a 5×20 mm area of a central area of the development roller 1. Regarding the toner dispersion, when the developing device 100 is stopped, the toner concentration in the developing device 100 is increased by about 1% by supplying the toner to the second developer housing portion 120 via the toner loading hole 121, and while the developing device 100 is driven, the toner dispersed in the development roller 1 is observed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing device to supply toner in a developer comprising the toner and a carrier to an electrostatic latent image formed on an image carrier and to develop the electrostatic latent image, the developing device comprising:

a first developer housing portion comprising a development member to attach the developer to an outer circumference thereof to supply the toner to the image carrier, and a first agitator to agitate and transfer the developer in a first axis direction;

a second developer housing portion comprising a toner loading hole to load the toner, and a second agitator to agitate and transfer the developer in a second axis direction that is opposite with respect to the first axis direction; and a barrier wall to divide the developing device into the first developer housing portion and the second developer housing portion, and has a first communication opening located on a lower stream side of the second axis direction and a second communication opening located on a lower stream side of the first axis direction to allow the developer to be transferred in the first axis direction and the second axis and circulated between the first developer housing portion and the second developer housing portion, wherein the developing device satisfies $1.8 \leq Wa/Wb \leq 3.0$, wherein Wa represents a mass of the developer in the first developer housing portion and Wb represents a mass of the developer in the second developer housing portion at an equilibrium state.

2. The developing device of claim 1, wherein the developing device satisfies $$Tcirc \leq \frac{3}{2} \times \frac{Wa}{TMA \times Pa \times PPM},$$

wherein PPM represents a number of reference paper sheets on which an image is printed per minute, Pa represents an area of each reference paper sheet, Tcirc represents a time during which the developer is circulated once, and TMA represents an amount of the toner in a unit area of the image carrier.

3. The developing device of claim 1, wherein the developing device satisfies $$Z1 > Z2,$$

wherein Z1 represents a pore size of the first communication opening, and Z2 represents a pore size of the second communication opening.

4. The developing device of claim 1, wherein each of the first agitator and the second agitator is an auger comprising a shaft and a blade, wherein a pitch of the blade of the first agitator is smaller than a pitch of the blade of the second agitator.

5. The developing device of claim 1, wherein the developing device satisfies $$0 < Y - \{X + (Z1 + Z2)/2\} < 15 \text{ mm},$$

wherein Z1 represents a pore size of the first communication opening, Z2 represents a pore size of the second communication opening, X represents an inner interval between the first and second communication openings, and Y represents an effective image area of the development member.

6. A developing device to supply toner in a developer comprising the toner and a carrier to an electrostatic latent image formed on an image carrier and to develop the electrostatic latent image, the developing device comprising:

a first developer housing portion comprising a development member to attach the developer to an outer circumference thereof to supply the toner to the image carrier, and a first agitator to agitate and transfer the developer in a first axis direction;

a second developer housing portion comprising a toner loading hole to load the toner, and a second agitator to agitate and transfer the developer in a second axis direction that is opposite with respect to the first axis direction; and a barrier wall to divide the developing device into the first developer housing portion and the second developer housing, comprising a first communication opening located on a lower stream side of the second axis direction and a second communication opening located on a lower stream side of the first axis direction to allow the developer to be transferred in the first axis direction and the second axis direction and circulated between the first developer housing portion and the second developer housing portion, wherein the developing device satisfies $$0<Y-\{X+(Z1+Z2)/2\}<15\text{ mm},$$

wherein

Z1 represents a pore size of the first communication opening, Z2 represents a pore size of the second communication opening, X represents an inner interval between the first communication opening and the second communication opening, and Y represents an effective image area of the development member.

7. An electrophotographic image forming apparatus comprising a developer comprising toner and a carrier, the electrophotographic image forming apparatus comprising:

an image carrier on which an electrostatic latent image is formed; and a developing device to supply the toner to the electrostatic latent image to develop the electrostatic latent image, comprising:

a first developer housing portion comprising a development member to attach the developer to an outer circumference thereof to supply the toner to the image carrier, and a first agitator to agitate and transfer the developer in a first axis direction, a second developer housing portion comprising a toner loading hole to load the toner, and a second agitator to agitate and transfer the developer in a second axis direction that is opposite with respect to the first axis direction, and a barrier wall to divide the developing device into the first developer housing portion and the second developer housing portion, and has a first communication opening located on a lower stream side of the second axis direction and a second communication opening located on a lower stream side of the first axis direction to allow the developer to be transferred in the first axis direction and the second axis and circulated between the first developer housing portion and the second developer housing portion, wherein the developing device satisfies $1.8 \leq Wa/Wb \leq 3.0$, wherein Wa represents a mass of the developer in the first developer housing portion and Wb represents a mass of the developer in the second developer housing portion at an equilibrium state.

8. The electrophotographic image forming apparatus of claim 7, wherein the electrophotographic image forming apparatus satisfies $$Tcirc \leq \frac{3}{2} \times \frac{Wa}{TMA \times Pa \times PPM},$$

wherein PPM represents a number of reference paper sheets on which an image is printed per minute, Pa represents an area of each reference paper sheet, Tcirc represents a time during which the developer is circulated once, and TMA represents an amount of the toner in a unit area of the image carrier.

9. The electrophotographic image forming apparatus of claim 7, wherein the electrophotographic image forming apparatus satisfies Z1>Z2, wherein Z1 represents a pore size of the first communication opening, and Z2 represents a pore size of the second communication opening.

10. The electrophotographic image forming apparatus of claim 7, wherein each of the first agitator and the second agitator is an auger comprising a shaft and a blade, wherein a pitch of the blade of the first agitator is smaller than a pitch of the blade of the second agitator.

11. The electrophotographic image forming apparatus of claim 7, wherein the electrophotographic image forming apparatus satisfies $$0<Y-\{X+(Z1+Z2)/2\}<15\text{ mm},$$

wherein

Z1 represents a pore size of the first communication opening, Z2 represents a pore size of the second communication opening, X represents an inner interval between the first communication opening and the second communication opening, and Y represents an effective image area of the development member.

12. An electrophotographic image forming apparatus comprising a developer comprising toner and a carrier, the electrophotographic image forming apparatus comprising:

an image carrier on which an electrostatic latent image is formed; and the developing device to supply the toner to the electrostatic latent image to develop the electrostatic latent image, comprising:

a first developer housing portion comprising a development member to attach the developer to an outer circumference thereof to supply the toner to the image carrier, and a first agitator to agitate and transfer the developer in a first axis direction;

a second developer housing portion comprising a toner loading hole to load the toner, and a second agitator to agitate and transfer the developer in a second axis direction that is opposite with respect to the first axis direction, and a barrier wall to divide the developing device into the first developer housing portion and the second developer housing, comprising a first communication opening located on a lower stream side of the second axis direction and a second communication opening located on a lower stream side of the first axis direction to allow the developer to be transferred in the first axis direction and the second axis direction and circulated between the first developer housing portion and the second developer housing portion, wherein the developing device satisfies $$0<Y-\{X+(Z1+Z2)/2\}<15\text{ mm},$$

wherein

Z1 represents a pore size of the first communication opening, Z2 represents a pore size of the second communication opening, X represents an inner interval between the first communication opening and the second communication opening, and Y represents an effective image area of the development member.

13. An electrophotographic image forming apparatus, comprising:

a photoconductive device upon which an electrostatic latent image is formed;

a first developer housing portion, comprising:

a developing roller to supply toner to the photoconductive device to transfer the electrostatic latent image onto a printing medium, and a first agitator to rotate in a first axis direction to agitate and transfer the toner to the developing roller; and a second developer housing portion, comprising a second agitator to rotate in a second axis direction to agitate and transfer the toner to the first agitator, wherein a mass of the toner within the first developer housing portion is maintained at a level greater than or equal to a mass of the toner within the second developer housing portion.

14. The electrophotographic image forming apparatus of claim 13, such that at least one of the first agitator and the second agitator is altered with respect to at least one of a pitch, a rotational speed, and a circumference to increase a charge of the toner within the first developer housing portion.

15. The electrophotographic image forming apparatus of claim 13, further comprising a barrier wall to separate the first agitator from the second agitator, comprising:

a first communication opening to allow the toner to transfer from the second agitator to the first agitator in a first direction, and a second communication opening to allow the toner to transfer from the first agitator to the second agitator in a second direction.

16. The electrophotographic image forming apparatus of claim 15, wherein the image forming apparatus satisfies $1.8 \leq Wa/Wb \leq 3.0$, such that Wa represents a mass of the toner in the first developer housing portion and Wb represents a mass of the developer in the second developer housing portion at an equilibrium state.

17. The electrophotographic image forming apparatus of claim 15, wherein the image forming apparatus satisfies $0 < Y - \{X + (Z1 + Z2)/2\} < 15$ mm, such that Z1 represents a pore size of the first communication opening, Z2 represents a pore size of the second communication opening, X represents an inner interval between the first communication opening and the second communication opening, and Y represents an effective image area of the developing roller.

18. The electrophotographic image forming apparatus of claim 15, wherein changing a pore size of at least one of the first communication opening and the second communication opening changes an amount of the toner per unit area on the developing roller.

19. The electrophotographic image forming apparatus of claim 15, further comprising a toner concentration sensor to detect a concentration of the toner within the second developer housing portion; and a controller to control the concentration of the toner within the second developer housing portion based on the detected concentration.

20. The electrophotographic image forming apparatus of claim 13, further comprising:

a toner loading member to supply the toner to the second agitator.

21. The electrophotographic image forming apparatus of claim 20, wherein the toner loading member is detachable.

* * * * *